US009595427B2

(12) United States Patent
Decker et al.

(10) Patent No.: US 9,595,427 B2
(45) Date of Patent: Mar. 14, 2017

(54) ACQUISITION OF FRAGMENT ION MASS SPECTRA OF BIOPOLYMERS IN MIXTURES

(71) Applicant: Bruker Daltonik GmbH, Bremen (DE)

(72) Inventors: Jens Decker, Bremen (DE); Ralf Hartmer, Hamburg (DE)

( * ) Notice: Subject to any disclaimer, the term of this patent is extended or adjusted under 35 U.S.C. 154(b) by 94 days.

(21) Appl. No.: 14/597,414

(22) Filed: Jan. 15, 2015

(65) Prior Publication Data

US 2015/0214020 A1 Jul. 30, 2015

(30) Foreign Application Priority Data

Jan. 29, 2014 (DE) ..... 10 2014 001 003

(51) Int. Cl.
*H01J 49/16* (2006.01)
*H01J 49/00* (2006.01)

(52) U.S. Cl.
CPC ..... *H01J 49/0036* (2013.01); *H01J 49/165* (2013.01)

(58) Field of Classification Search
CPC combination set(s) only.
See application file for complete search history.

(56) References Cited

U.S. PATENT DOCUMENTS 7,586,089 B2 * 9/2009 Hartmer ..... H01J 49/0031 250/281
2006/0141516 A1 * 6/2006 Kobold ..... C12Q 1/6872 435/6.11
2007/0158544 A1 * 7/2007 Hartmer ..... H01J 49/0031 250/282
2011/0006200 A1 * 1/2011 Loboda ..... H01J 49/0031 250/283
2011/0012016 A1 * 1/2011 Maier ..... C12Q 1/04 250/282

FOREIGN PATENT DOCUMENTS

WO 2011004236 A1 1/2011

OTHER PUBLICATIONS

Herzog, Ronny et al., A novel informatics concept for high-throughput shotgun lipidomics based on the molecular fragmentation query language, Genome Biology, Jan. 19, 2011, 12:R8, pp. 1-25, BioMed Central Ltd.

* cited by examiner

*Primary Examiner* — Phillip A Johnston
*Assistant Examiner* — Hsien Tsai
(74) *Attorney, Agent, or Firm* — Benoit & Cote Inc.

(57) ABSTRACT

The invention relates to the selection of the most favorable ion species for the acquisition of fragment ion mass spectra when the ionization creates biopolymers in different charge states. The invention proposes a particularly fast method of selecting the most favorable parent ions for fragmentation of the different biopolymers from mass spectra, where the ionization is by electrospray ionization (ESI) or other ionization methods which produce similarly diverse charge states and which, for each biopolymer, contain many signal patterns of ions of the different charge states and different isotopic compositions. The selection is carried out in such a way that it does not measure more than one ion species from one biopolymer. Moreover, the most favorable filter passband width for isolating an ion species for fragmentation can be stated in each case.

16 Claims, 4 Drawing Sheets

ACQUISITION OF FRAGMENT ION MASS SPECTRA OF BIOPOLYMERS IN MIXTURES

BACKGROUND OF THE INVENTION

Field of the Invention

The invention relates to the selection of the most favorable ion species from a mixture of biopolymers for the acquisition of fragment ion mass spectra when the ionization creates biopolymer ions in different charge states.

Definitions

Instead of the statutory "unified atomic mass unit" (u), this document uses the unit "dalton" (Da), which was added in the last (eighth) 2006 edition of the document "The International System of Units (SI)" of the "Bureau International des Poids et Mesures" on an equal footing with the unified atomic mass unit. As is noted in the document, this was done primarily in order to allow the use of the units Kilodalton (kDa), millidalton (mDa) and similar compositions.

The term "ion species" is used here to mean all ions of a substance S in a defined charge state z, i.e. $S^{z+}$, where z is the number of elementary charges of the ion. An ion species includes all ions of different isotopic compositions. An ion species can be characterized by stating a value for M/z where M is not, however, the monoisotopic mass (usually designated as m), as is often the convention in mass spectrometry, but the molecular mass averaged over the isotopic compositions M (previously called the molecular weight).

Description of the Related Art

The identification of biopolymers, especially proteins, with molecular masses M between 5 and 100 kilodaltons in body fluids, is of great interest in pharmacology, biology and medicine. The following discussion relates mainly to proteins. Examples of very interesting proteins are antibodies, usually enzymatically split into three partial molecules with masses of around 50, 50 and 25 kilodaltons. The identification is preferably carried out by mass spectrometric analysis of fragment ion spectra after liquid chromatographic separation, although it is often not possible to completely separate many proteins chromatographically. The ionization is usually carried out by electrospraying (ESI). For each protein, the mass spectrum contains regular patterns of multiply charged ions with a broad, usually relatively smooth distribution of the intensities for the ions with different charge numbers z, the most intense ion species usually being located at mass-to-charge ratios M/z between 600 and 1200 daltons. Each ion species characterized by its mass-to-charge ratio M/z exhibits a narrow distribution of ions of different isotopic composition. When large numbers of different substances are present, there are many overlaps of the isotopic distributions.

If a protein is subjected to electrospray ionization, then the number of ion species of different charge states z depends on the mass M of the protein; proteins with high masses generally have a larger number of different charge states than those with low masses. In the electrospray method, a small protein such as ubiquitin, with an average molecular mass M=8564.76 Da, typically produces eight different charge states with charge numbers z=7, 8, 9, . . . , 14, when it is sprayed with a typical solvent mixture of water, acetonitrile and formic acid (FIG. 1). Bovine serum albumin with an average mass of M=66.4 kDa is present in the mass spectrum in 32 different charge states z (FIG. 2). The structure of the protein, the use of denaturizing solvents, and the existence of disulfide bonds within the protein can affect the charge distribution; the strong interlinking within the bovine serum albumin means that, during the ionization, relatively few protons can be taken up as charge carriers, which in turn means that the most intense ion species are relatively heavy and appear at around M/z=1200 Da.

The identification of a protein requires the acquisition of a mass spectrum of fragment ions of a selected ion species of this protein with a mass-to-charge ratio M/z, where usually all the isotopic signals of this ion species are included in the fragmentation. The mass spectrometric analysis is usually carried out in time-of-flight mass spectrometers with orthogonal ion injection (OTOF), wherein the isolation of the selected ion species and its fragmentation are usually carried out in quadrupole mass filters and ion storage devices. The multiply charged protein molecules are usually fragmented by transferring electrons from suitable, negatively charged donor molecule ions (ETD=electron transfer dissociation). The acquisition of a good mass spectrum of the fragment ions takes around five to ten seconds, and the proteins elute in the chromatogram within a window of only around 30 to 45 seconds, and can thus be mass spectrometrically evaluated only during this time. It is therefore important to be able to quickly and automatically select from an unfragmented mass spectrum the correct ion species to be fragmented for the individual proteins, and they must not overlap with other protein ions.

As can be seen in FIG. 3, with an ESI mass spectrum of a mixture, it is not possible to visually recognize which ion signal belongs to which protein, although this mixture contains only four proteins. Methods for charge deconvolution do, however, exist, for example the well-known program "MaxEnt" (maximum entropy charge deconvolution), which uses an entropy definition to compute the most probable deconvoluted mass spectrum for the measured mass spectrum. The result of such a deconvolution of the mass spectrum in FIG. 3 is shown in FIG. 4; the four proteins of the mixture are clearly recognizable. Unfortunately, the "MaxEnt" program requires one to two minutes for the deconvolution on fast and powerful computers, and therefore cannot be used for a fast real-time search for suitable candidates for the fragmentation, especially not when several substances of a mixture have approximately the same retention times and thus elute simultaneously and unresolved from the chromatograph.

For the fragmentation, the simplest method according to the Prior Art simply first fragments the ion species with the highest intensity and acquires its fragment ion mass spectrum, then the ion species with the second highest intensity and so on. This means, however, that frequently ions of the same proteins, but with different charge numbers, are measured again and again before a second protein is finally found which differs from the first. Proteins of lower intensity (such as the insulin ions in FIGS. 3 and 4) are often not found at all. A second method according to the Prior Art also selects the ion species in the order of the intensities, but analyzes the separations of the isotopic signals to determine the charge z of this ion species, and from this the mass M of the protein via the known M/z. If the second highest ion species has the same mass M, it is not selected for the fragmentation, but instead the third highest ion species is investigated, etc. However, this method can only be used when the individual isotopic signals are well separated from each other, i.e. when the mass resolution of the mass analyzer used is sufficiently high; it fails in mass spectrometers which do not have an extremely high resolving power. It is almost impossible to use the method for masses above 30 kilodaltons because they require resolving powers of more than R=60 000, and realizing this with time-of-flight mass spectrometers is a challenge.

There is therefore a need for methods which can rapidly select the most suitable ion species for fragmentation from a complex mass spectrum of mixed proteins. FIG. 3 shows an example of such a complex mass spectrum. The selection should either cover each biopolymer involved, or a predetermined number of biopolymers. A complete deconvolution is not required. It is advantageous to also determine the width of the isotopic distribution Δ(M/z) in order to achieve the optimum setting for the mass filter for the isolation of this ion species, for example.

SUMMARY OF THE INVENTION

This invention proposes a method whereby the most favorable ion species of the various biopolymers involved are selected particularly quickly for fragmentation from biopolymer mass spectra which contain many signal patterns of ions of different charge states and different isotopic compositions, as are produced by electrospray ionization, for example. The selection proceeds without several ions of the same biopolymer with different charge states being measured unnecessarily. Moreover, the most favorable filter pass-band width for the isolation of an isotopic signal pattern, i.e. for the isolation of the selected ion species, can be stated in each case.

In other words, the invention proposes a particularly fast method by which only one most favorable ion species for each biopolymer of the mixture is selected for fragmentation. The ion species are selected from mass spectra that are acquired using electrospray ionization (ESI), or similar ionization methods, and contain many signal patterns of ions of the different charge states and different isotopic compositions for each biopolymer. Moreover, the most favorable filter pass-band width for isolating the ion species selected for fragmentation can be stated in each case.

This method involves first setting a starting range in the measured mass spectrum, for example 600<M/z<1200 daltons, and a target range for a target spectrum, for example 5000<M<60 000 daltons. The target range is preferably subdivided into narrow sub-channels ("bins") of, for example, 5 daltons each. Furthermore, it is possible to set the range of the charge numbers z, for example 5≤z≤60. The range here can be comprehensively defined as every integer between the upper limit and the lower limit. In some embodiments it can also be useful to define a range which does not cover all integers between the upper limit and the lower limit, but skips some, or a quantity of discontinuous charge numbers. The measured spectrum can now be smoothed with a fast algorithm and reduced to a smaller number of data points i(M/z) with equidistant M/z values, i.e. it can be transformed from a measurement parameter scale (for example the time of flight) to a mass scale. It is advantageous here if the isotopic signals subsequently no longer appear separately, since only the envelopes are used. Alternatively, line spectra obtained first from a measured time-of-flight spectrum with the aid of a peak-picking algorithm are transferred to a mass spectrum on a mass scale.

The M/z value of each ion signal in the range selected in the smoothed and reduced mass spectrum is now multiplied in turn, with the integers n from the range of the charge numbers z, for example with n=5, 6, 7, . . . , 60, and corrected by subtracting the mass n×p of the n charge carriers. The charge carriers for positive ions are protons with positive proton mass p. The intensity i(M/z) is summed to an intensity sum Σi in the bin of the target spectrum for the particular result $M_n$=(M/z)×n×p as long as the computed mass $M_n$ is still in the target range. When the computed mass $M_n$ no longer falls within the target range, the multiplication series for this ion signal is terminated. This target spectrum now contains many completely meaningless entries; but it has surprisingly been found that the sum intensities Σi stand out clearly at the positions of actually present biopolymers of mass M, since the signals of all the charge states z of this biopolymer sum up here. From these prominent signals it is now possible to select suitable ion species for fragmentation, for example in the order of decreasing total intensity Σi from the bin in each case, for example the ion species M/z with the greatest intensity i(M/z).

As defined in this invention, the charge carriers can also have a negative mass when, for example, the biopolymers are ionized by means of the negative electrospray method, and the substance is multiply deprotonated. The range or the quantity of the charge numbers would contain negative entries n in this case. Biopolymers which are particularly suitable for ionization with negative polarity are desoxyribonucleic acids (DNA) or glycosaminoglycans. For multiply deprotonated negatively charged ions, the charge carriers are (missing) protons with a negative proton mass −p, so to speak. The computation rule remains essentially the same as described above, however.

It remains to examine whether the selected ion species stands alone or appears to be overlapped by other ion species, particularly ones which are more intense. If an overlap exists, the next most intense ion species is selected from the bin for this protein and is examined for overlap, until an ion species is found without severe overlap. If only the dominant summand is stored, the overlap is examined as above with the aid of the reduced M/z spectrum; if there is a serious overlap with a strong signal, then, for the protein of mass M, ion species M/z adjacent to the ion species originally selected are examined for suitable intensity i(M/z) and overlap, until a suitable ion species is found.

Preferably, an iterative method can be used, where after selecting an ion species for a first biopolymer, all the ion species M/z of the selected biopolymer are deleted from the smoothed and reduced spectrum, and then the process of multiplications and storages in the target spectrum is carried out again. Using this iterative method, it is possible to find biopolymers of very low concentration.

The width of the isotopic distribution for the selected ion species can be computed by assuming that the biopolymers have an average composition comprising hydrogen (H), carbon (C), nitrogen (N), oxygen (0), sulfur (S) and phosphorus (P), as corresponds to the statistical average for the biopolymers concerned. It has been found that the isotopic distribution of different ion species for a mass-to-charge ratio M/z becomes narrower, the larger the mass M of the biopolymer. The width can be used to delete the ion species in the iterative method and also to set the mass filter for the isolation of this ion species.

Figure 1:
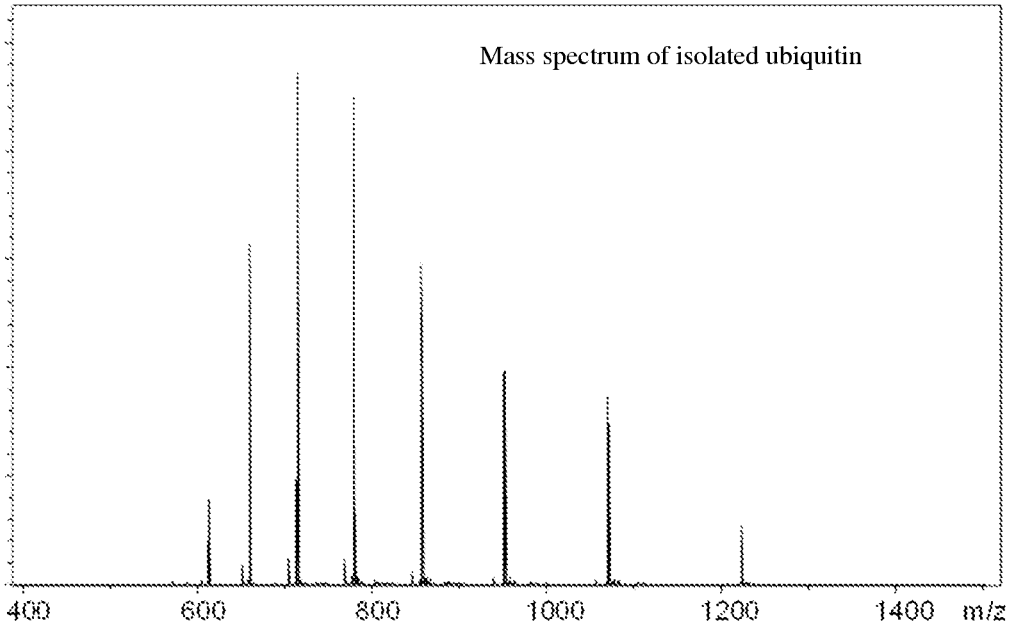
FIG. 1 shows an ESI mass spectrum of ubiquitin (m=8.564 kDa) with seven ion species M/z, whose charge numbers range from z=14 to z=7.
Figure 2:
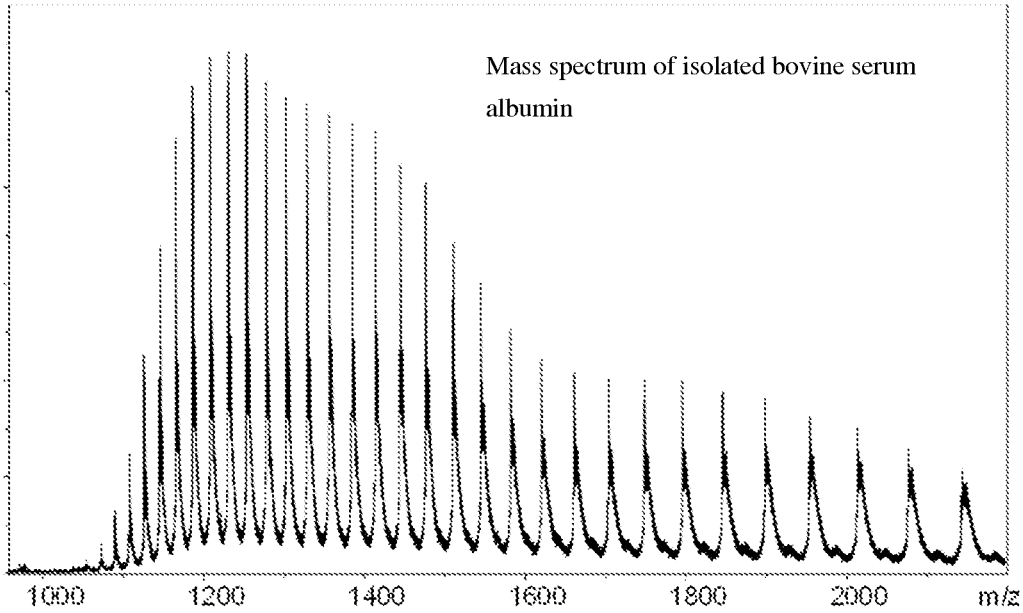
FIG. 2 depicts an ESI mass spectrum of bovine serum albumin (m=66.4 kDa), with a distribution of the ion species of different charge states, whose maximum is slightly above M/z=1200 Da due to strong internal interlinking. The full spectrum shows 32 ion species. The individual ion signals are each broadened by several adducts.
Figure 3:
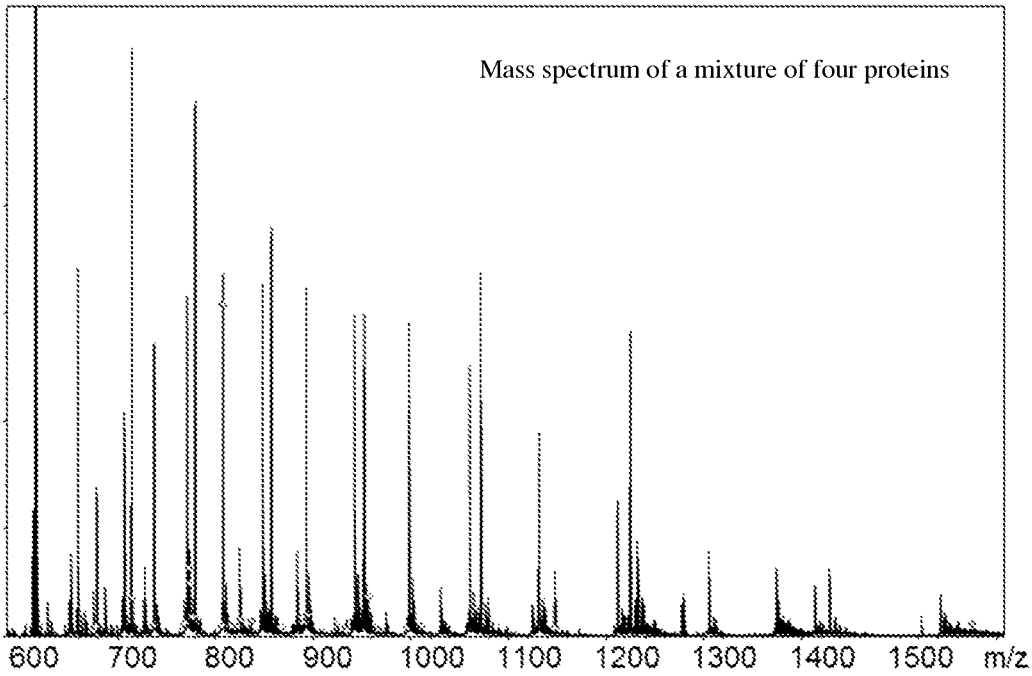
FIG. 3 shows a measured mass spectrum of a mixture of insulin (~5.74 kDa), ubiquitin (~8.564 kDa), cytochrome C (~12.38 kDa) and myoglobin (~17.05 kDa), ionized by electrospraying. The multiply charged ions of these proteins, only four in number, are superimposed so that they can no longer be differentiated with the naked eye.
Figure 4:
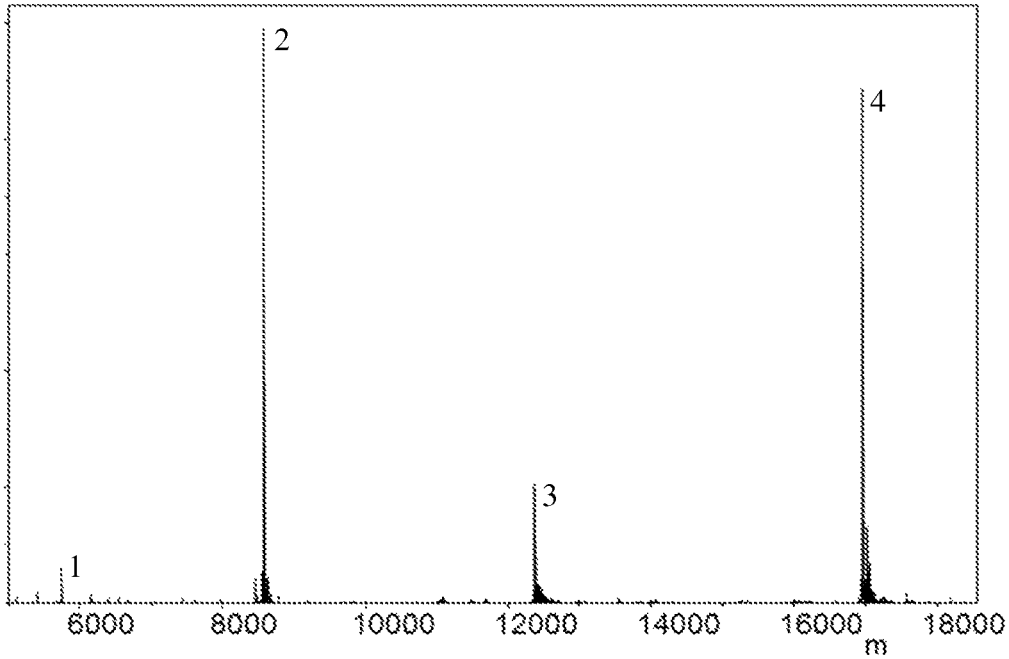
FIG. 4 depicts a deconvolution of the mass spectrum of FIG. 3 by the known program MaxEnt, which shows the four main components very well. Even with fast computers, the deconvolution takes several minutes, however.
Figure 6:
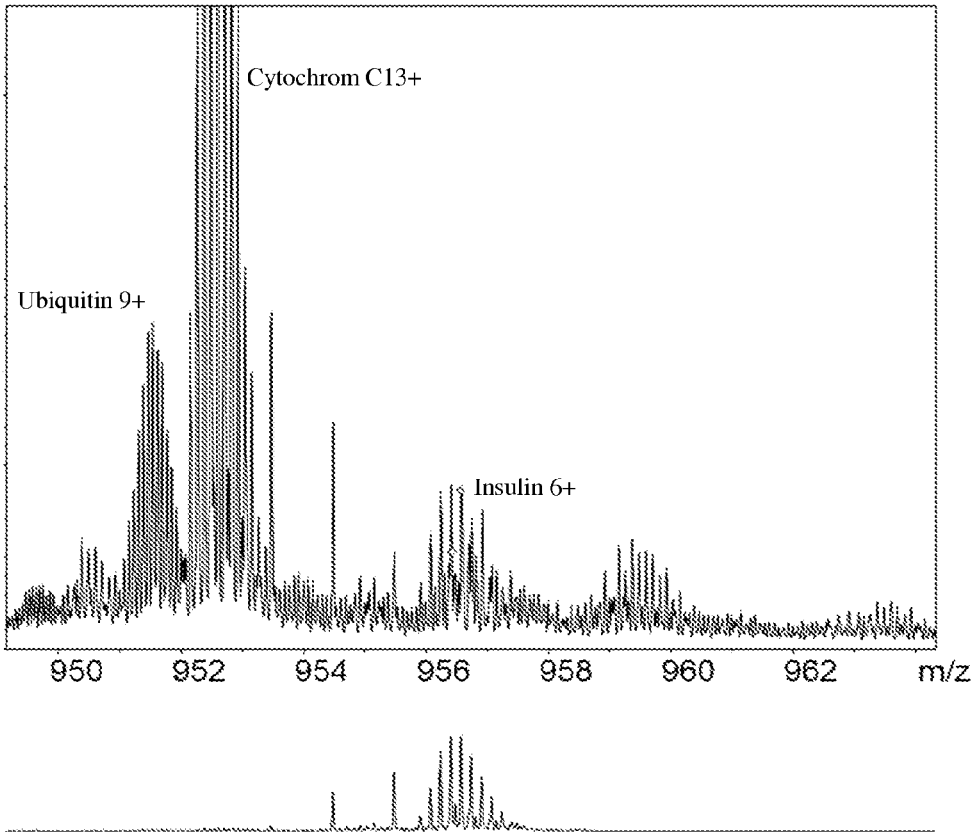

The top illustration in FIG. 6 depicts a narrow section of only 12 daltons from the mass spectrum measured at high resolution in FIG. 3, with ubiquitin 9+ (left, M/z≈951.5 Da), cytochrome C 13+ (M/z≈952.5 Da) and, roughly in the center of the diagram, insulin 6+ (M/z≈956.2 Da). Below this is a mass spectrum which is obtained when only the insulin ions with a six-fold charge are filtered out with a mass filter. Ions filtered out in this way can be used for fragmentation.

Figure 7:
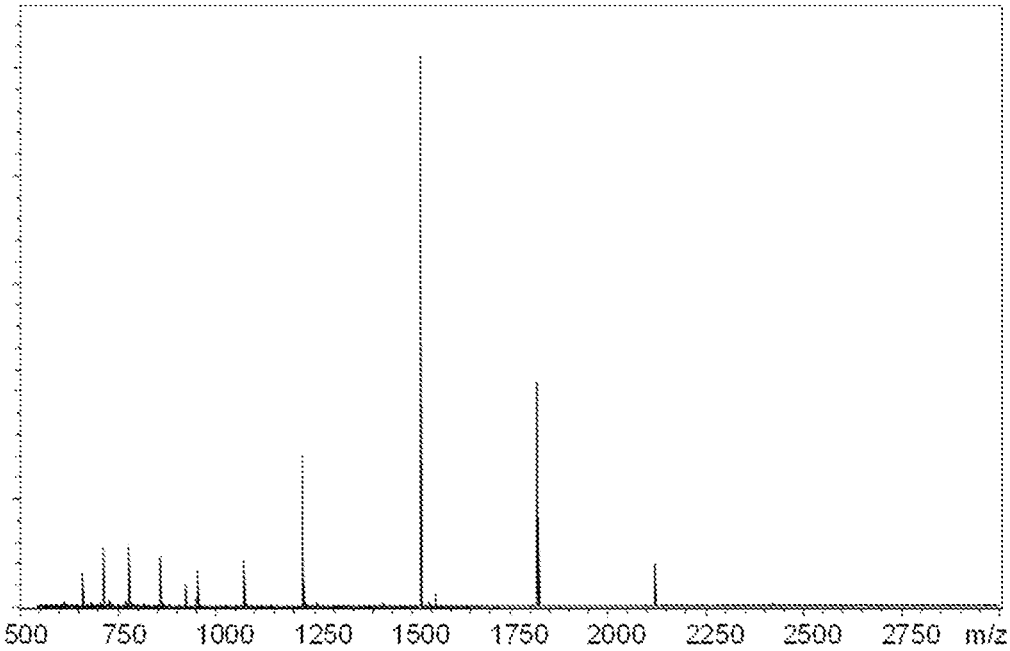

FIG. 7 depicts a mass spectrum of a calibration solution with the singly charged ions of masses m=622, 922, 1222, 1522, 1822, 2122 Da (z=1 in each case), in which a mass spectrum of ubiquitin is embedded with its multiply charged ion species.

Figure 8:
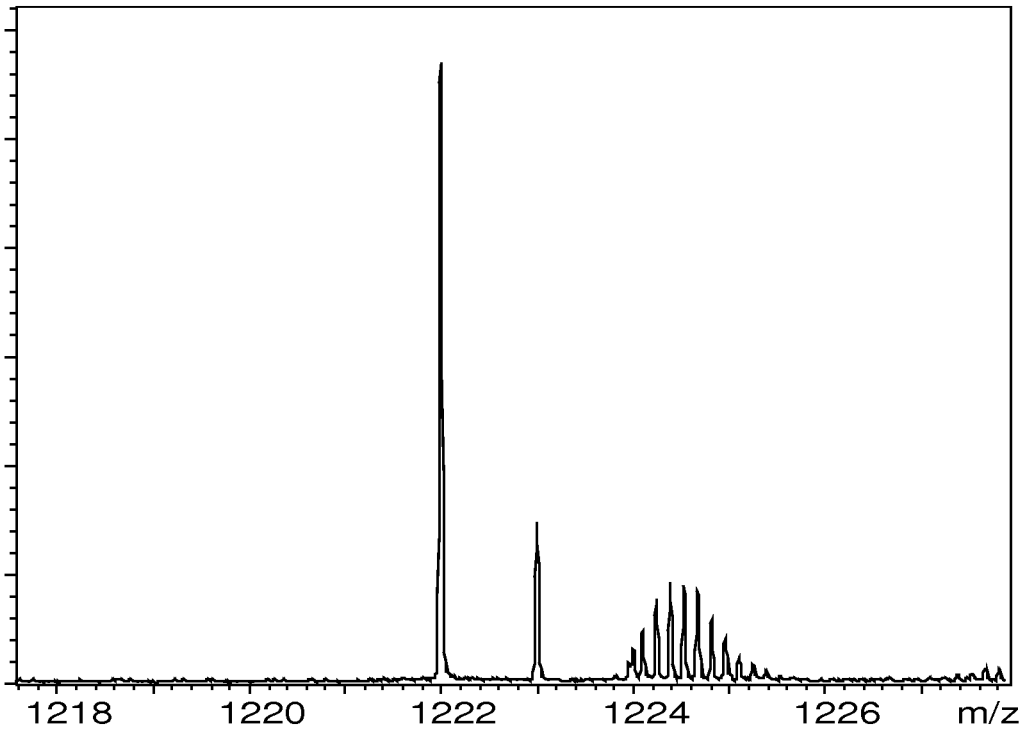

FIG. 8 shows, at higher graphical resolution, the values around mass m=1222 Da from the spectrum of FIG. 7 with the isotopic signal m=1223 Da and the isotopic distribution of ubiquitin 7+.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

As already explained above, this invention proposes methods for very rapid selection of the most favorable ion species for fragmentation when analyzing mass spectra of biopolymer mixtures which contain a signal pattern of ions of different charge states and different isotopic compositions for each of the biopolymers. Such signal patterns of ions of the different charge states and different isotopic compositions can result from electrospray ionization, for example. With this method, it is possible to prevent the same biopolymer being measured several times via ion species with different charges, which ultimately costs measuring time, without providing any new information on the composition of the biopolymer mixture. With the computers used in powerful mass spectrometers, the computing process takes only around 10 to 100 milliseconds; the search can therefore be carried out in real time with the aid of a measured spectrum of unfragmented ions after three or four acquisitions of fragment ion spectra. Moreover, the most favorable pass-band width of the mass filter for isolating an ion species for fragmentation can be given in each case. An ESI mass spectrum of a mixture of only four proteins with signals of more than 50 ion species is depicted in FIG. 3.

The method can be applied not only to ESI mass spectra, but also to spectra from different ionization methods if they produce patterns of ions of different charge states. One example is DESI (Desorption Electrospray Ionization), where an electrospray beam is directed onto a solid sample.

For the computation, it is preferable to first set a start range of the mass-to-charge ratios in the measured mass spectrum, for example 600<M/z<1200 daltons, and a target range of masses in a target spectrum, for example $5000<M_{Target}<60\ 000$ daltons. The target spectrum should cover the molecular masses of all biopolymers of the mixture. The target range is preferably subdivided into narrow channels ("bins"), for example 11,000 bins each of 5 daltons. Furthermore, it is possible to set the range of the charge numbers z, which in one example embodiment serve as natural integers n for multiplication processes, for example $5 \leq z \leq 60$. The measured spectrum may now be subjected to a background noise subtraction and smoothed with a fast algorithm. It is definitely advantageous if the isotopic signals then no longer appear separately, and only the envelopes can be used. The spectrum is then transformed from a measurement parameter scale, for example a time of flight scale, to a mass scale, and reduced to a small number of data points i(M/z) per ion species. Alternatively, line spectra obtained first from a measured time-of-flight spectrum with the aid of a peak-picking algorithm are transferred to a mass spectrum on a mass scale. In this reduced mass spectrum with no background noise, the patterns of the charge distributions of the biopolymers involved are still superimposed, and, depending on the chromatographic conditions, adducts of the biopolymer ions, for example with $Na^+$, $K^+$ or other ions, can also be present.

The M/z value of the first ion signal of the reduced mass spectrum which rises above the zero line is now multiplied in turn with all the integers n of the set range of the charge numbers z, for example with n=5, 6, 7, . . . , 60, and corrected by subtracting the masses of the charge carriers, i.e. the mass p of the protons for positive ions. The results are $M_n=(M/z)\times n=n\times p$. For each resulting $M_n$, the intensities i(M/z) are summed up in the bins $M_{bin}$ belonging to $M_n$. The method for the first ion signal is terminated when the computed mass $M_n=(M/z)\times n-n\times p$ is no longer within the target range. These calculations are repeated for each ion signal M/z in the mass spectrum until all the ion signals, i.e. all the M/z values of the reduced mass spectrum, have been subjected to this multiplication and storage method.

Figure 5:
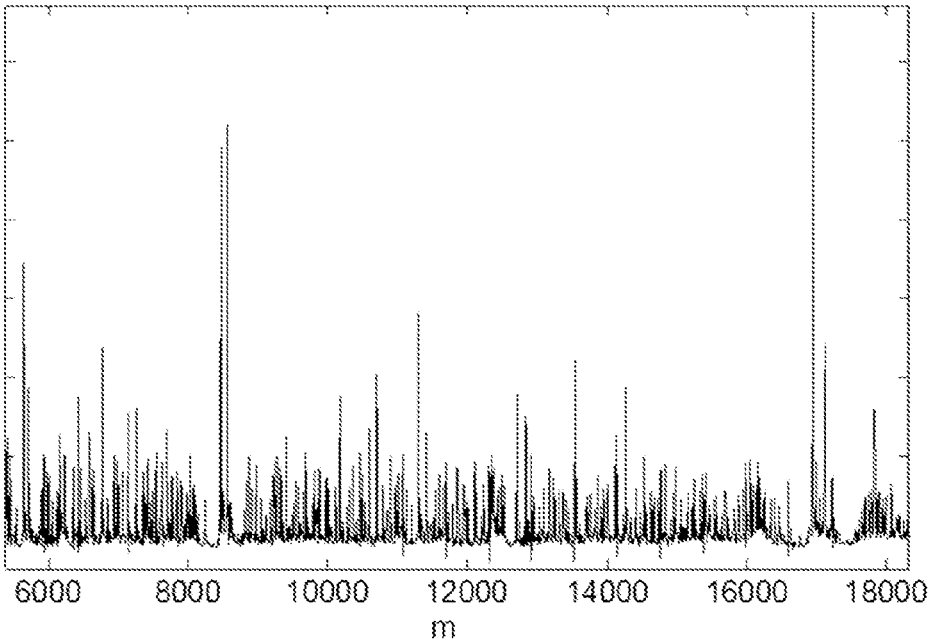
FIG. 5 shows a target spectrum as can be generated from the mass spectrum of FIG. 1 by a method according to the principles of the invention.

This target spectrum now contains many completely meaningless entries; but surprisingly, the intensity sums $\Sigma i(M_{bin})$ stand out clear and far at the positions of proteins of mass M which are actually present, since here the signals of all the charge states z of a protein of mass $M=M_{bin}$ add up. FIG. 5 shows the target spectrum as obtained from the measured spectrum of FIG. 3 by applying the computational rule described above.

In a first embodiment, these prominent signals are now used to select the proteins with mass $M_s$, for example in the order of decreasing intensity. For each of these proteins $M_s$, the most suitable ion species from the biomolecule is then selected for fragmentation, for example by calculating all mass-to-charge ratios $M_s/z=M_s/n+p$ belonging to this biomolecule $M_s$ and selecting the $M_s/z$ with the highest intensity $i(M_s/z)$ for the acquisition of a fragment ion spectrum. Each ion species $M_s/z$ selected may be then examined to see whether it stands alone or whether other ion species overlap and thus interfere. If a severe overlap exists, the next most intense ion species of this protein is selected and examined for overlap, until an ion species which does not severely overlap is found.

To avoid too much unused time between acquisition of a mass spectrum for selecting the ion species and subsequent acquisition of fragment ion spectra, it is possible to start with the acquisition of the fragment ion mass spectrum as soon as the first ion species has been determined, and to then continue the determination of further ion species. The selection of at least the first ion species can also be undertaken on a mass spectrum which was acquired in a shorter time with lower quality.

In a second and preferred embodiment, the algorithm described here is executed iteratively. To this end, only one ion species with the highest intensity $\Sigma i(M_{bin})$ is initially selected for a biomolecule of mass $M_s=M_{bin}$ If no other signals are superimposed on this selected ion species M/z, it can be used for the fragmentation. As the next step, all peaks of the ion species $M_s/z=M_s/n+p$ of this biomolecule $M_s$ are deleted from the reduced spectrum. A suitable average value can be assumed for the distribution widths of the isotopic signals; it is more advantageous, however, to compute the distribution width $\Delta_i(M_s/z)$ of the isotopic signals for the ion species $M_s/z$ from the mass $M_s$ in accordance with the method described below. A new target spectrum is compiled, in accordance with the algorithm described, from the spectrum modified by deletion in this way. Then a suitable ion species of the now strongest biomolecule is again selected from the new target spectrum. This method is continued iteratively until a predetermined number of biomolecules have been found or until the ion signals available have all been processed.

The width $\Delta_i(M/z)$ of the isotopic distribution for the ion species selected can be computed by assuming that the average composition of the biopolymers comprises H, C, N, O, S and P, as corresponds to the statistical average. For proteins, the averaged composition corresponds to the molecular formula $C_{4.9384}H_{7.7583}N_{1.3577}O_{1.4773}S_{0.0417}$. From this, a number $k_i(M,s)$ can be computed for each mass M, which indicates how many isotopic lines of a protein of this mass Mare above a percentage intensity threshold s. For an intensity threshold of five percent of the maximum intensity, the equation $k_i(M, 5\%)=\sqrt{(a\times M/m_u-b)}$ applies, with $m_u=1$ Da as the approximated separation between the isotopic masses and the constants a=0.016955 and b=2.77. Other types of biopolymers have slightly different constants a and b, which are known to the specialist. The width of the ion species M/z is then $\Delta_i(M/z)=(k_i(M,s)-1)\times m_u/z$.

The selection of suitable ion species is followed by measurement of the fragment ion mass spectra. The selected ion species, which continues to flow out of the ion source, is isolated in a mass filter in the mass spectrometer and fragmented in a suitable cell, and the mass spectrum of the fragment ions is measured. The multiply charged protein molecules are usually fragmented by transfer of electrons from suitable, negatively charged donor molecule ions (ETD=electron transfer dissociation). For protein identification, a partial sequence of the amino acids, which is as long as possible, is determined from the fragment ion mass spectrum in a way which is known as such. For modified proteins, the change in comparison with normal forms is determined from the fragment ion spectrum. The various analytical goals will not be discussed in more detail here.

The determination of the width $\Delta_i(M/z)$ of the isotopic distribution can also be used for the most favorable setting of the mass filter for isolating the ion species selected.

It should be noted here that it does not always have to be a mixture of several heavy biomolecules, whose various ion species overlap. The method can also be used when a mass spectrum which consists mainly of several singly charged ions contains only the distribution of multiply charge ion species of one heavy molecule, as is depicted in FIG. 7. Here a mass spectrum with ubiquitin with its multiply charged ions is contained in the mass spectrum of a calibration solution with the ions of the monoisotopic masses m=622, 922, 1222, 1522, 1822, 2122 Da (z=1 in each case). FIG. 8 shows an enlarged illustration of the values around mass m=1222 Da with the isotopic signal m=1223 Da and the isotopic distribution of ubiquitin 7+.

It has already been noted above that the ion species of certain substances also form adducts with alkali ions due to salts in the chromatography liquid, in particular $Na^+$ and $K^+$. Usually only a few percent of the substance molecules form such adducts. In the adducts, a proton is replaced by the alkali ion. As a rule, only one alkali ion is adducted to each molecule, usually to all the ion species of the particular substance. These adducts thus appear as new substances in the mixture of substances, and are 22 or 38 daltons heavier than their adduct-free original substances. They will be found by the method described in the same way as the other substances of the mixture.

The method according to the invention relates fundamentally to the analysis of the different biopolymers with different molecular masses M in a mixture. The method is used if an ionization method such as electrospraying or another ionization method produces large numbers of charge states for each of the biomolecules, providing many ion species of the individual proteins, each with different charge numbers z, and the analysis is carried out with the aid of the mass spectra of fragment ions of an ion species with mass-to-charge ratio M/z selected from the ion mixture. The method essentially consists in carrying out the selection of the protein ion species M/z for the fragmentation with the aid of a computed target spectrum with preselected mass range $M_{min}<M<M_{max}$. The target spectrum is formed by adding together all the intensities i(M/z) at those positions in the target spectrum which are computed by multiplying the mass-to-charge ratios M/z of all the ion species which are present in the measured mass spectrum with all the integers n in each case and subtracting the mass of the charge carriers n×p, as long as the resulting mass $M_n=(M/z)\times n-n\times p$ lies within the preselected mass range of the target spectrum. The intensities i(M/z) of the ion species involved are therefore added together at the position $M_n$. The mass p is the mass of the charge carriers of the ion species; for positive ions, p is the mass of a proton. The target spectrum can particularly be subdivided into bins, where the intensities i(M/z) are added together in the bin into which the computed resulting mass $M_n=(M/z)\times n-n\times p$ falls in each case. It is particularly favorable to record, for each bin, the mass-to-charge ratio M/z and intensity i(M/z) of all the ion species concerned in a table belonging to the target spectrum. However, memory and computing time are saved by recording only the intensities i and mass-to-charge ratios M/z of the dominant ion species.

With this method, it is not necessary to always use all the ion species of the measured mass spectrum, instead, it is possible to limit the ion species M/z to a mass range of $(M/z)_{min}<M/z<(M/z)_{max}$. It is particularly preferable to only take into account the integers n of a preselected range $z_{min}<n<z_{max}$, or even only a discontinuous list of integers.

The ion species M/z to be fragmented can be selected using the value of the intensity sums of the target spectrum and the value i(M/z) of the intensities of the individual ion species M/z, for example in decreasing order of the intensities $\Sigma(M_{Target})$ and i(M/z).

To generate clean fragment ion mass spectra, it is favorable to examine whether the selected ion species overlap with other, more intense ion species before they are used for a fragmentation. If an overlap exists, a different ion species M/z should be selected.

The width $\Delta_i(M/z)$ of the isotopic distribution for the ion species selected can be computed, as described above, by assuming that the average composition of the biopolymers comprises H, C, N, O, S and P, as corresponds to the statistical average. It has been found that the isotopic distribution at the location of an ion species of mass-to-charge ratio M/z becomes narrower, the larger the mass m of the protein. The computed width $\Delta_i(M/z)$ can be used to set the mass filter to isolate the ion species selected, and also to delete all M/z contributions of a biopolymer of mass m in the iterative method.

When the ionization of a mixture of biopolymers produces a multitude of ion species of each of the individual biopolymers, each with different mass-to-charge ratios M/z, it is difficult to select ion species for the acquisition of fragment ions spectra. According to the invention, the most favorable method for analyzing the biopolymers with the aid of mass spectra of fragment ions, comprises the following steps:

a) acquiring a mass spectrum of the mixture of ions, with peaks on a mass scale, each peak having an M/z and an intensity i(M/z) value, M being the molecular mass, and z being the number of elementary charges of the ion,
b) defining a start mass-to-charge range $(M/z)_{min}<M/z<(M/z)_{max}$ of the mass spectrum,
c) defining a target mass range $M_{min}<M<M_{max}$ of a spectrum of molecular masses M, divided into bins $M_{bin}$,
d) defining a range of natural numbers $n_{min}<n<n_{max}$, covering most of the charge states z of the ion mixture,
e) performing the calculations $M_n=M/z)\times n-n\times p$, using $p=m(H^+\approx+1$ Da for positive ions and $p=-m(H^+)\approx-1$ Da for negative ions, with the value M/z of the first peak in the defined mass-to-charge range not used hitherto and with all numbers n of the defined range of natural numbers, and adding the intensities i(M/z) of the peaks M/z into the bins $M_{bin}$ into which the values $M_n$ fall, as long as the result $M_n$ still falls into the defined target mass range,
f) repeating step e) with all peaks of the defined mass-to-charge range,
g) selecting the molecular mass $M_s$ of bin $M_{bin}$ with the highest sum of intensities, characterizing the molecular mass of one of the biomolecules of the mixture,
h) calculating all mass-to-charge ratios $M_s/z=M_s/n+p$ belonging to this biomolecule $M_s$ and selecting the $M_s/z$ with the highest intensity $i(M_s/z)$ for the acquisition of a fragment ion spectrum,
i) erasing all peaks $M_s/z$ belonging to biopolymer $M_s$ from the mass spectrum,
j) performing steps e) to i) iteratively until a defined number of ion species for the acquisition of fragment ion spectra are found or until the mass spectrum is exhausted,
k) acquiring the fragment ion spectra of the selected ion species.

In this method, the acquisition of fragment ion spectra may be started as soon as the first ion species for a fragment ion spectrum is selected. Furthermore, the ion species selected in step h) may be rejected if an overlap with a neighboring peak exists, and another ion species may be selected for this biomolecule. The mass spectrum acquired in step a) may be background subtracted and smoothed before the other steps are performed, or may be reduced by a peak picking method to a line spectrum.

The invention has been described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

The invention claimed is:

1. A method for analyzing biopolymers of a mixture whose ionization produces several ion species of the individual biopolymers, each with different mass-to-charge ratios M/z, with aid of mass spectra of fragment ions of selected ion species M/z of the ion mixture, M being a molecular mass, and z being a number of elementary charges of the ion, wherein selection of only one ion species M/z for fragmentation in order to identify a biopolymer is carried out with aid of a computed target spectrum with preselected mass range $M_{in}<M<M_{max}$, the target spectrum being formed by multiplying the mass-to-charge ratios M/z of the ion species which are present in a measured spectrum with all natural numbers n of a pre-selected range, and subtracting a mass of the charge carriers n×p, as long as resulting masses $M_n=(M/z)\times n-n\times p$ are in the preselected mass range of the target spectrum, and the intensities i(M/z) of the ion species (M/z) involved being added together at the position $M_n$ in each case, where p is a positive or negative single charge carrier mass.

2. The method according to claim 1, wherein the measured spectrum is subjected to a background noise subtraction, a smoothing and a transformation from a measurement parameter scale to a mass scale before a target spectrum is compiled.

3. The method according to claim 1, wherein the target spectrum is subdivided into bins, and the intensities i(M/z) are added in the bin into which the resulting mass $M_n=(M/z)\times n-n\times p$ falls.

4. The method according to claim 3, wherein for each bin the mass-to-charge ratios M/z and intensities i(M/z) of all the ion species involved are recorded in a table belonging to the target spectrum.

5. The method according to claim 3, wherein for each bin the mass-to-charge ratio M/z and intensity i(M/z) of the ion species with the highest intensity are recorded in a table belonging to the target spectrum.

6. The method according to claim 1, wherein not all the ion species of the measured spectrum are used, but only the ion species M/z of a mass range $(M/z)_{min}<M/z<(M/z)_{max}$.

7. The method according to claim 1, wherein the ion species M/z to be fragmented are selected according to the value of the intensity sums $\Sigma i(M_{Target})$ of the target spectrum and then the value i(M/z) of the intensities of the individual ion species M/z.

8. The method according to claim 1, wherein a selected ion species is examined for overlaps with other ion species and, if there is an overlap, a different ion species M/z is selected for fragmentation.

9. The method according to claim 1, wherein after selecting a first ion species M/z for a biopolymer, all the ion species of this biopolymer are deleted from the measured spectrum and a new target spectrum is formed from the reduced measured spectrum for the selection of a second ion species, and the process is repeated in an iterative way, and in each step of the iteration a new ion species is selected until a predetermined number of biopolymers are found or until the ion signals of the measured spectrum have all been processed.

10. The method according to claim 9, wherein a width $\Delta_i(M/z)$ of the isotopic distribution is used for the deletion of an ion species, and the width of the isotopic distribution is computed from the average elemental composition of the biopolymer under analysis.

11. A method for analyzing biopolymers of a mixture with aid of mass spectra of fragment ions of selected ion species M/z of the mixture of ions generated from the biopolymer mixture, when the ionization produces a multitude of positive ion species of each of the individual biopolymers, each with different mass-to-charge ratios M/z, comprising the steps a) acquiring a mass spectrum of the mixture of ions, with peaks on a mass scale, each peak having an M/z and an intensity i(M/z) value, M being the molecular mass, and z being the number of elementary charges of the ion defining a charge state of the ion, b) defining a start mass-to-charge range $(M/z)_{min}<M/z<(M/z)_{max}$, c) defining a target mass range $M_{min}<M<M_{max}$, divided into bins $M_{bin}$, d) defining a range of natural numbers $n_{min}<n<n_{max}$, covering most of the charge states z of the ion mixture, e) performing calculations $M_n=(M/z)\times n-n\times p$, using p=m(H+)≈+1 Da for positive ions and p=−m(H+)≈−1 Da for negative ions, with the value M/z of the first peak in the defined mass-to-charge range not used hitherto and with all numbers n of the defined range of natural numbers, and adding the intensities i(M/z) of the peaks M/z into the bin $M_{bin}$ into which $M_n$ falls, as long as the result $M_n$ still falls into the defined target mass range, f) repeating step e) with all peaks of the defined mass-to-charge range, g) selecting the molecular mass $M_s$ of bin $M_{bin}$ with the highest sum of intensities, characterizing the molecular mass of one of the biomolecules of the mixture, h) calculating all mass-to-charge ratios $M_s/z=M_s/n+p$ and selecting the $M_s/z$ with the highest intensity $i(M_s/z)$ for acquisition of a fragment ion spectrum, i) erasing all peaks $M_s/z$ belonging to biopolymer $M_s$ from the mass spectrum, j) performing steps e) to i) iteratively until a defined number of ion species for the acquisition of fragment ion spectra are found or until the mass spectrum is exhausted, k) acquiring the fragment ion spectra of the selected ion species.

12. The method according to claim 11, wherein the acquisition of fragment ion spectra is started as soon as the first ion species for a fragment ion spectrum is selected.

13. The method according to claim 11, wherein the ion species selected in step h) is rejected if an overlap with a neighboring peak exists, and another ion species is selected for this biomolecule.

14. The method according to claim 11, wherein the mass spectrum acquired in step a) is background subtracted and smoothed before the other steps are performed.

15. The method according to claim 11, wherein the mass spectrum acquired in step a) is reduced by a peak picking method to a line spectrum.

16. The method according to claim 1, wherein p is a positive or negative proton mass.

* * * * *